US010372055B2

(12) United States Patent
Murata

(10) Patent No.: US 10,372,055 B2
(45) Date of Patent: Aug. 6, 2019

(54) IMAGE FORMING APPARATUS AND METHOD OF CONTROLLING THE SAME

(71) Applicant: Konica Minolta, Inc., Chiyoda-ku, Tokyo (JP)

(72) Inventor: Hisashi Murata, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/833,487

(22) Filed: Dec. 6, 2017

(65) Prior Publication Data

US 2018/0173130 A1 Jun. 21, 2018

(30) Foreign Application Priority Data

Dec. 16, 2016 (JP) ..... 2016-244274

(51) Int. Cl.
*G03G 15/02* (2006.01)
*G03G 21/20* (2006.01)

(52) U.S. Cl.
CPC ..... *G03G 15/0266* (2013.01); *G03G 15/0216* (2013.01); *G03G 21/20* (2013.01)

(58) Field of Classification Search
CPC ..... G03G 15/0266; G03G 15/0216
See application file for complete search history.

(56) References Cited

U.S. PATENT DOCUMENTS 4,783,716 A * 11/1988 Nagase ..... G03G 21/06 250/326
5,229,818 A * 7/1993 Nakahara ..... G03G 15/0283 399/46
5,365,316 A * 11/1994 Motoyama ..... G03G 15/0283 363/25
6,947,678 B2 * 9/2005 Ohtomo ..... G03G 15/0856 399/27
9,921,541 B2 * 3/2018 Shimizu ..... G03G 21/1676
2009/0103936 A1 * 4/2009 Tomiie ..... G03G 15/0216 399/50
2009/0103940 A1 * 4/2009 Tomiie ..... G03G 15/0283 399/89

(Continued)

FOREIGN PATENT DOCUMENTS

JP 2014-38259 A 2/2014

OTHER PUBLICATIONS

Machine Translation of JP2018066981 (Year: 2016).*
Bib Data of JP2018066981 (Year: 2016).*

*Primary Examiner* — Benjamin R Schmitt
*Assistant Examiner* — Milton Gonzalez
(74) *Attorney, Agent, or Firm* — Buchanan Ingersoll & Rooney PC

(57) ABSTRACT

An image forming apparatus includes a photoconductor, a charging member, a first power supply circuit which supplies electric power to the charging member, a detector configured to detect a current value of an alternating current which flows to the charging member, and a controller configured to control an operation of the first power supply circuit. The controller is configured to lower a frequency of alternating-current power supplied to the charging member by the first power supply circuit when the current value detected by the detector in application of a voltage of a prescribed value to the charging member by the first power supply circuit is equal to or smaller than a predetermined value.

12 Claims, 5 Drawing Sheets

(56) References Cited

U.S. PATENT DOCUMENTS

| | | | | |
|---|---|---|---|---|
| 2010/0239286 | A1* | 9/2010 | Hanashi | G03G 15/0266 399/50 |
| 2013/0039669 | A1* | 2/2013 | Fukushima | G03G 15/065 399/27 |
| 2013/0045023 | A1* | 2/2013 | Kosaka | G03G 15/80 399/88 |
| 2013/0177328 | A1* | 7/2013 | Fukuda | G03G 15/0266 399/43 |
| 2014/0147140 | A1* | 5/2014 | Shirakata | G03G 15/0266 399/50 |
| 2015/0234338 | A1* | 8/2015 | Murauchi | G03G 15/80 399/50 |
| 2016/0320746 | A1* | 11/2016 | Makino | G03G 15/0266 |
| 2016/0334732 | A1* | 11/2016 | Okubo | G03G 15/0266 |
| 2017/0090332 | A1* | 3/2017 | Ganko | G03G 15/0266 |
| 2017/0205727 | A1* | 7/2017 | Makiura | G03G 15/0266 |
| 2017/0285509 | A1* | 10/2017 | Takagami | G03G 15/0266 |
| 2018/0074427 | A1* | 3/2018 | Nakajima | G03G 15/0266 |
| 2018/0107135 | A1* | 4/2018 | Kinokuni | G03G 15/0266 |

* cited by examiner

IMAGE FORMING APPARATUS AND METHOD OF CONTROLLING THE SAME

Japanese Patent Application No. 2016-244274 filed on Dec. 16, 2016 including description, claims, drawings, and abstract the entire disclosure is incorporated herein by reference in its entirety.

BACKGROUND

Technological Field

The present disclosure relates to an image forming apparatus and a method of controlling the same, and particularly to an image forming apparatus using alternating-current power and a method of controlling the same.

Description of the Related Art

An image forming apparatus which forms an image with electrophotography or electrostatic recording has conventionally been used. In such an image forming apparatus, recently, adoption of contact charging for uniformly charging a surface of a photoconductor by arranging a roller type charging member in contact with or in proximity to the surface of the photoconductor and applying an oscillating voltage as a direct-current voltage and an alternating-current voltage being superimposed on each other to the charging member has become mainstream from a point of view of a low-voltage process, a small amount of ozone generation, and low costs.

In contact charging, a peak-to-peak voltage Vpp of a charging voltage is determined, for example, as follows. A first approximation function and a second approximation function between a peak-to-peak value of a voltage and an alternating current value are derived, and a differential function indicating a differential value between these two functions is derived. Such a peak-to-peak voltage value that a rate of increase in current differential value per unit peak-to-peak voltage is a prescribed value K is specified as a peak-to-peak voltage Vpp used in control.

Japanese Laid-Open Patent Publication No. 2014-38259 discloses a technique to change peak-to-peak voltage Vpp in accordance with an environment where an image forming apparatus is located. More specifically, the apparatus increases a value for peak-to-peak voltage Vpp for compensating for defective charging of a charging member due to lowering in temperature when a temperature at a location where the apparatus is located lowers.

With increase in peak-to-peak voltage Vpp, however, abrasion of a film of a photoconductor tends to proceed in an image forming apparatus. Therefore, running costs of the image forming apparatus may increase. Furthermore, when significant increase in peak-to-peak voltage Vpp is allowed in the image forming apparatus, a circuit which is capable of providing a high output should be adopted as a circuit to supply electric power to a charging member. Therefore, cost for manufacturing the image forming apparatus may increase. Reduction in cost for the image forming apparatus is demanded.

SUMMARY

To achieve at least one of the above-mentioned objects, according to an aspect of the present disclosure, an image forming apparatus reflecting one aspect of the present disclosure is provided. The image forming apparatus includes a photoconductor, a charging member provided in proximity to the photoconductor, a first power supply circuit configured to supply alternating-current power to the charging member, a detector configured to detect a current value of an alternating current which flows to the charging member, and a controller configured to control an operation of the first power supply circuit. The controller is configured to lower a frequency of alternating-current power supplied to the charging member by the first power supply circuit when the current value detected by the detector in application of a voltage of a prescribed value to the charging member by the first power supply circuit is equal to or smaller than a predetermined value.

To achieve another of the above-mentioned objects, according to an aspect of the present disclosure, a method of controlling an image forming apparatus reflecting one aspect of the present disclosure is provided, the image forming apparatus including a photoconductor and a charging member provided in proximity to the photoconductor and supplied with electric power containing an alternating-current component. The method includes obtaining a value of a current which flows to the charging member when a voltage of a prescribed value is applied to the charging member and lowering a frequency of alternating-current power supplied to the charging member when the obtained value of the current is equal to or smaller than a predetermined value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

[Technical Concept]

Figure 1:
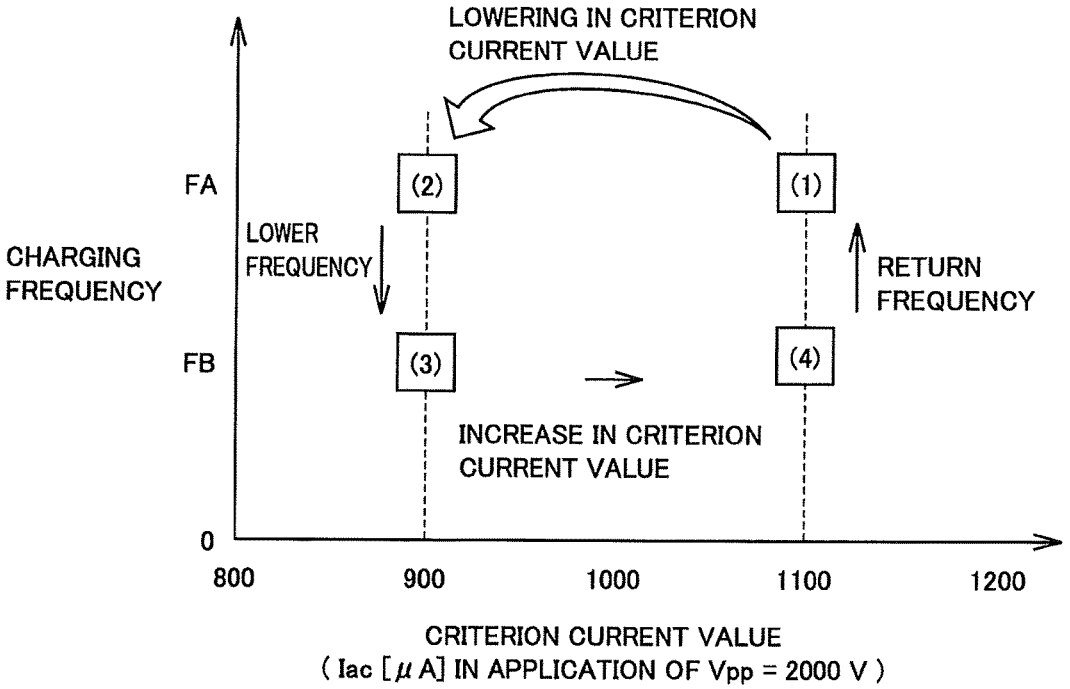
FIG. 1 is a diagram for illustrating a technical concept realized by an image forming apparatus according to the present disclosure.

FIG. 1 is a diagram for illustrating a technical concept realized by an image forming apparatus according to the present disclosure. In the image forming apparatus according to the present disclosure, a frequency of alternating-current power supplied to a charging roller (one example of a charging member) is lowered in response to the fact that a value of a current which flows to the charging roller in application of a voltage of a prescribed value (for example, 2000 V) to the charging roller is equal to or smaller than a predetermined value. The charging member in the present disclosure may be in a shape other than a cylindrical shape, such as a prismatic shape.

In the graph shown in FIG. 1, the ordinate represents a frequency of alternating-current power supplied to the charging roller of the image forming apparatus (hereinafter also referred to as a "charging frequency") and the abscissa represents a value of a current which flows to the charging roller in application of a voltage of a prescribed value to the charging roller (hereinafter also referred to as a "criterion current value"). In the example shown in FIG. 1, variation in charging frequency is shown with a "frequency FA" and a "frequency FB." A first frequency shown as "frequency FA" is higher than a second frequency shown as "frequency FB."

In the example in FIG. 1, the charging frequency is controlled to "frequency FA" until the criterion current value attains to a predetermined value ("900 μA" in the example in FIG. 1). When the criterion current value is lowered to the predetermined value due to an internal temperature of an image forming apparatus 200, the charging frequency is controlled to "frequency FB." Thereafter, when the criterion current value increases, the charging frequency is returned to "frequency FA." More detailed description will be given below.

The graph in FIG. 1 shows four states (a state (1) to a state (4)) of the image forming apparatus.

As shown as the state (1) in the example in FIG. 1, when the criterion current value is greater than the predetermined value (for example, "900 μA"), "frequency FA" is set as the charging frequency.

Thereafter, as shown as the state (2), when an instruction to print is received while the criterion current value is equal to or smaller than the predetermined value (900 μA), the image forming apparatus sets "frequency FB" as the charging frequency and performs printing.

Thereafter, as shown as the state (3), when the criterion current value increases to a prescribed value (for example, "1100 μA") or greater, the image forming apparatus returns the charging frequency to "frequency FA" (the state (4)).

In the example in FIG. 1, in the image forming apparatus, the criterion current value (900 μA) defining a condition for change in charging frequency from "frequency FA" to "frequency FB" and the criterion current value (1100 μA) defining a condition for change in charging frequency from "frequency FB" to "frequency FA" are different from each other. The two criterion current values may be set to the same value.

[Configuration of Image Forming Apparatus]

Figure 2:
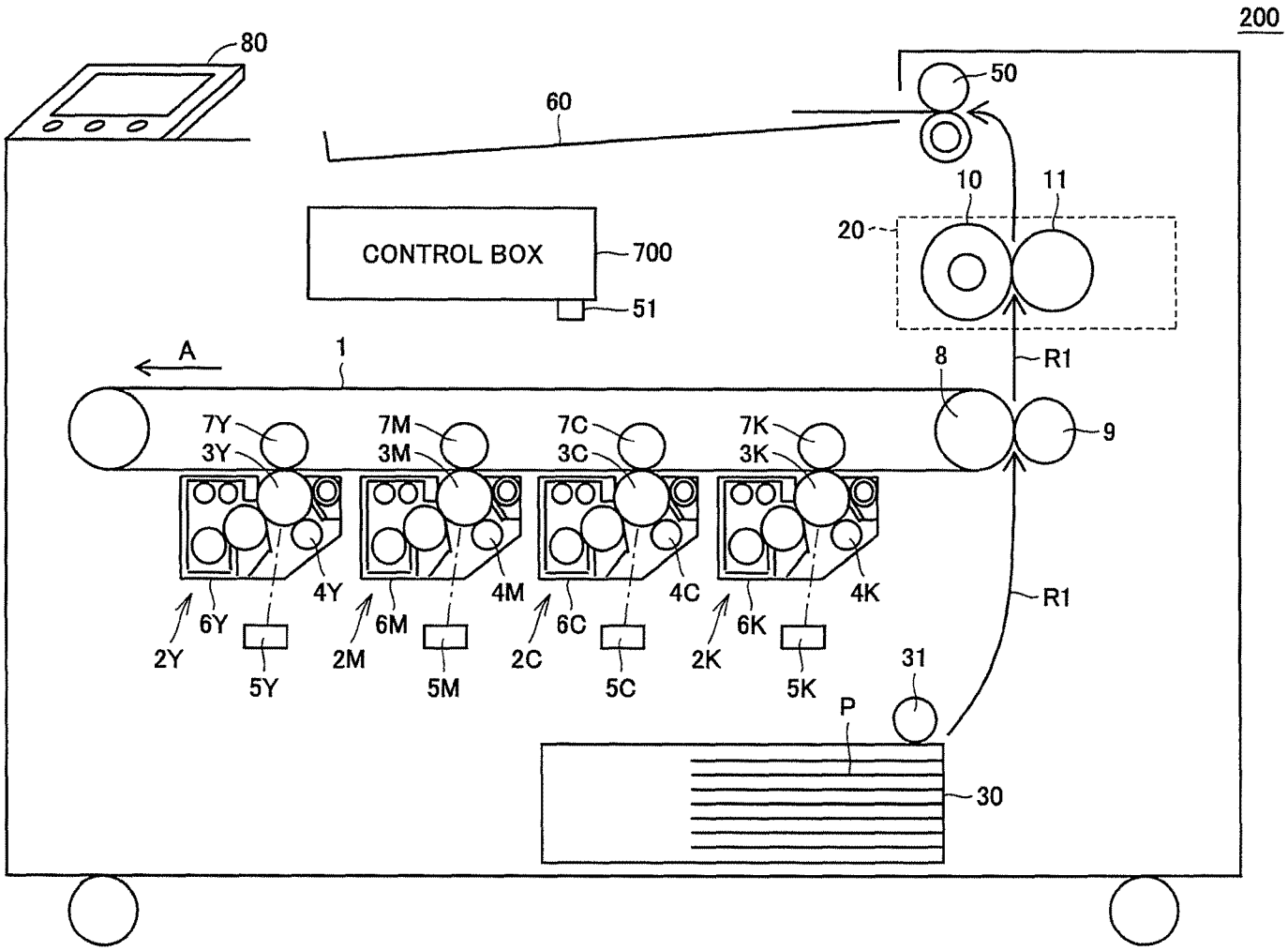
FIG. 2 is a diagram illustrating a configuration example of an image forming apparatus according to one embodiment.

FIG. 2 is a diagram illustrating a configuration example of image forming apparatus 200 according to one embodiment. In one embodiment, image forming apparatus 200 is an electrophotographic image forming apparatus such as a laser printer or a light emitting diode (LED) printer. As shown in FIG. 2, image forming apparatus 200 includes an intermediate transfer roller 1 as a belt member substantially in a central portion of the inside. Four imaging units 2Y, 2M, 2C, and 2K corresponding to colors of yellow (Y), magenta (M), cyan (C), and black (K), respectively, are arranged as being aligned along intermediate transfer roller 1 under a lower horizontal portion of intermediate transfer roller 1. Imaging units 2Y, 2M, 2C, and 2K have photoconductors 3Y, 3M, 3C, and 3K configured to be able to carry toner images, respectively.

Charging rollers 4Y, 4M, 4C, and 4K for charging corresponding photoconductors, print head portions 5Y, 5M, 5C, and 5K, development rollers 6Y, 6M, 6C, and 6K, and primary transfer rollers 7Y, 7M, 7C, and 7K opposed to photoconductors 3Y, 3M, 3C, and 3K with intermediate transfer roller 1 being interposed are arranged sequentially around photoconductors 3Y, 3M, 3C, and 3K along a direction of rotation thereof, respectively. In the present disclosure, the development roller represents one example of a development member. The development member may be in a shape other than a columnar shape, such as a prismatic shape.

A secondary transfer roller 9 is brought in pressure contact with a portion of intermediate transfer roller 1 supported by an intermediate transfer belt drive roller 8 and secondary transfer is performed in that region. A fixing and heating portion 20 including a fixing roller 10 and a pressurization roller 11 is arranged at a downstream position in a transportation path R1 subsequently to a secondary transfer region.

A paper feed cassette 30 is arranged in a lower portion of image forming apparatus 200. Paper feed cassette 30 is attachable to and removable from a main body of image forming apparatus 200. Paper P loaded and accommodated in paper feed cassette 30 is sent one by one from a sheet of paper located at the top to transportation path R1 as a paper feed roller 31 rotates.

An operation panel 80 is arranged in an upper portion of image forming apparatus 200. Operation panel 80 is constituted of a touch panel in which a touch sensor and a display are layered on each other and a physical button by way of example.

In one aspect, intermediate transfer roller 1, charging rollers 4Y, 4M, 4C, and 4K, primary transfer rollers 7Y, 7M, 7C, and 7K, and secondary transfer roller 9 may function as an ion conductive member. By way of example, such a conductive member may contain ion conductive rubber in which hydrin rubber, acrylonitrile butadiene rubber, or epichlorohydrin rubber is blended. Each conductive member may contain an appropriate ion conductive material depending on a required characteristic.

Though image forming apparatus 200 adopts a tandem intermediate transfer scheme in FIG. 2, limitation thereto is not intended. Specifically, image forming apparatus 200 may be an image forming apparatus adopting a cycle scheme or an image forming apparatus adopting a direct transfer scheme in which toner is directly transferred from a development apparatus to a printing medium.

Image forming apparatus 200 includes a control box 700 containing a control unit (a "controller 70" which will be described later with reference to FIG. 3) which controls an operation of image forming apparatus 200. A temperature sensor 51 is attached to control box 700. A position where temperature sensor 51 is located is not limited to the position shown in FIG. 2 so long as temperature sensor 51 can measure an internal temperature of image forming apparatus 200. The internal temperature refers, for example, to a temperature of the inside of a cover which covers an outer shell of image forming apparatus 200.

When an image signal is input to the control unit of image forming apparatus 200 from an external apparatus (such as a personal computer), the control unit generates digital image signals obtained by conversion of this image signal into signals of colors of yellow, cyan, magenta, and black and has print head portions 5Y, 5M, 5C, and 5K of respective imaging units 2Y, 2M, 2C, and 2K emit light based on the input digital signals for exposure. Electrostatic latent images formed on respective photoconductors 3Y, 3M, 3C, and 3K are thus developed by respective development rollers 6Y, 6M, 6C, and 6K to become toner images of respective colors. The toner images of these colors are primarily transferred onto intermediate transfer roller 1 which moves in a direction shown with an arrow A in FIG. 2 as being successively superimposed on one another as a result of functions of primary transfer rollers 7Y, 7M, 7C, and 7K. The toner image thus formed on intermediate transfer roller 1 is secondarily collectively transferred onto paper P as a result of a function of secondary transfer roller 9.

The toner image secondarily transferred to paper P reaches fixing and heating portion 20. The toner image is fixed to paper P as a result of functions of heated fixing roller 10 and pressurization roller 11. Paper P to which the toner image has been fixed is ejected to a paper ejection tray 60 through a paper ejection roller 50.

[Configuration in Vicinity of Charging Roller]

Figure 3:
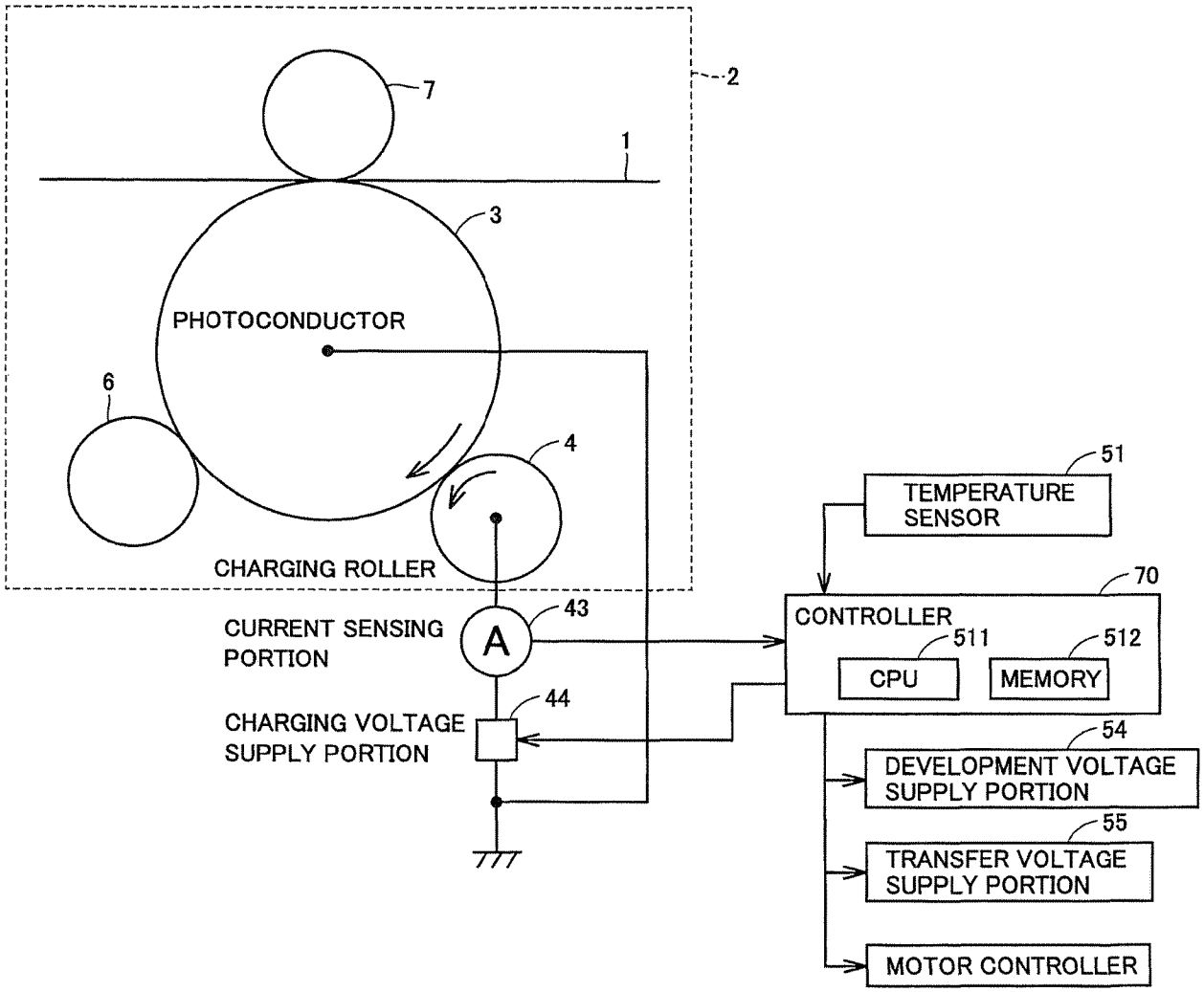
FIG. 3 is a diagram schematically showing a configuration in the vicinity of a charging roller in FIG. 2.

FIG. 3 is a diagram schematically showing a configuration in the vicinity of charging rollers 4Y, 4M, 4C, and 4K in FIG. 2. FIG. 3 shows imaging units 2Y, 2M, 2C, and 2K as "imaging unit 2" for illustrating a configuration common to four imaging units 2Y, 2M, 2C, and 2K. Photoconductors 3Y, 3M, 3C, and 3K are shown as "photoconductor 3" for illustrating a configuration common to four photoconductors 3Y, 3M, 3C, and 3K. Charging rollers 4Y, 4M, 4C, and 4K are shown as "charging roller 4" for illustrating a configuration common to four charging rollers 4Y, 4M, 4C, and 4K. Development rollers 6Y, 6M, 6C, and 6K are shown as "development roller 6" for illustrating a configuration common to four development rollers 6Y, 6M, 6C, and 6K. Primary transfer rollers 7Y, 7M, 7C, and 7K are shown as "primary transfer roller 7" for illustrating a configuration common to four primary transfer rollers 7Y, 7M, 7C, and 7K.

Referring to FIG. 3, in image forming apparatus 200, a charging voltage supply portion 44 supplies electric power to charging roller 4. Supplied electric power contains an alternating-current component. Supplied electric power may contain a direct-current component. Charging voltage supply portion 44 is implemented, for example, by a power supply circuit. Image forming apparatus 200 includes a current detector 43 for detecting a current value of an alternating-current component of electric power supplied to charging roller 4.

Image forming apparatus 200 includes controller 70. Controller 70 is accommodated, for example, in control box 700 (FIG. 2). Controller 70 includes a central processing unit (CPU) 511 representing one example of a processor which executes a program and a memory 512 which stores data such as a program. Controller 70 obtains a detection output from temperature sensor 51. Controller 70 controls an operation of charging voltage supply portion 44.

Image forming apparatus 200 includes a development voltage supply portion 54 which supplies electric power to development roller 6 and a transfer voltage supply portion 55 which supplies electric power to primary transfer roller 7. Electric power supplied to development roller 6 contains an alternating-current component. A frequency of electric power supplied to development roller 6 may be referred to as a "development frequency" in the description below. Each of development voltage supply portion 54 and transfer voltage supply portion 55 is implemented, for example, by a power supply circuit. Controller 70 controls an operation of development voltage supply portion 54 and transfer voltage supply portion 55.

In imaging unit 2, charging roller 4 abuts on photoconductor 3 and charging voltage supply portion 44 applies a voltage required for formation of an image to the charging roller. Charging voltage supply portion 44 supplies, for example, a voltage as a direct-current (DC) voltage and an alternating-current (AC) voltage being superimposed on each other to charging roller 4. As the voltage is applied from charging voltage supply portion 44 to charging roller 4, a potential difference is produced between a surface of charging roller 4 and photoconductor 3.

When a potential difference between the surface of charging roller 4 and photoconductor 3 is equal to or greater than a predetermined potential difference determined under the Paschen's law, discharging occurs and hence photoconductor 3 is charged. As charges move between charging roller 4 and charged photoconductor 3, a current flows. Current detector 43 detects a value of a current which flows between charging roller 4 and photoconductor 3. A value of the current which flows between charging roller 4 and photoconductor 3 in application of a voltage of a predetermined value to charging roller 4 may vary depending on image forming apparatus 200 (for example, a temperature, a humidity, or a barometric pressure) and a thickness of a film of photoconductor 3.

[Control (1) Based on Criterion Current Value]

In image forming apparatus 200, operation setting is made in stabilization control. The operation setting includes setting of peak-to-peak voltage Vpp of a voltage (charging voltage) applied to each of charging rollers 4Y, 4M, 4C, and 4K. Peak-to-peak voltage Vpp of the charging voltage is determined, for example, as follows. A first approximation function and a second approximation function between a peak-to-peak value of the voltage and an AC current value are derived, and then a differential function indicating a differential value between these two functions is derived. In deriving the first and/or second approximation function(s), a plurality of predetermined peak-to-peak voltage values (detection voltage values) are used for measurement of an AC current value.

Figure 4:
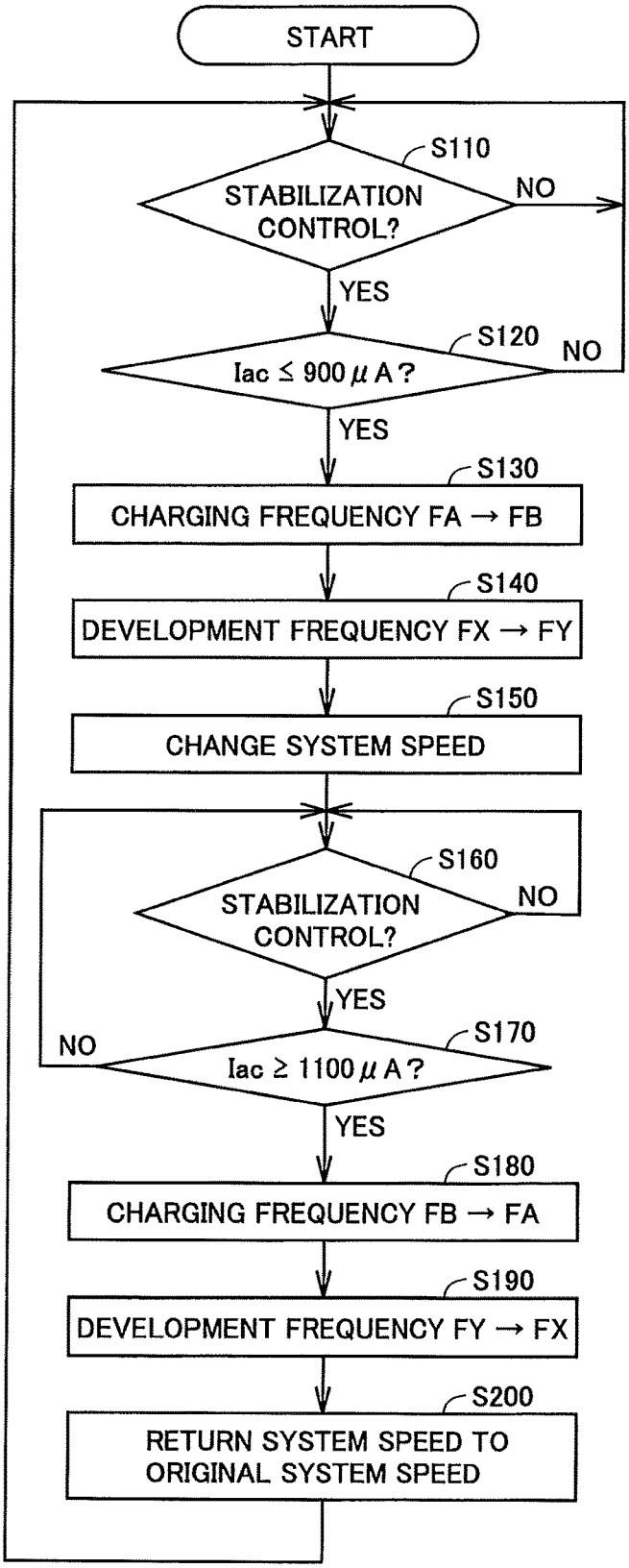
FIG. 4 is a flowchart of processing performed in the image forming apparatus.

Image forming apparatus 200 lowers a charging frequency when an AC current value obtained by using one voltage value (for example, 2000 V) of the detection voltage values is equal to or smaller than a predetermined value (for example, "900 μA" in FIG. 1). Such control is carried out, for example, by execution of a given program by CPU 511 (FIG. 3). FIG. 4 is a flowchart of processing performed by CPU 511. In the description below, a detection voltage value used for detection of a criterion AC current value among the detection voltage values is referred to as a "specific voltage value."

As shown in FIG. 4, whether or not timing of stabilization control in image forming apparatus 200 has come is determined in step S110. The process remains in step S110 until CPU 511 determines that the timing has come. When CPU 511 determines that the timing has come, it carries out stabilization control including setting of a charging voltage, and thereafter the process proceeds to step S120.

CPU 511 determines in step S120 whether or not a criterion current value Iac is equal to or smaller than a predetermined value (for example, "900 μA"). Criterion current value Iac is a value of a current which flows to charging roller 4 in application of the specific voltage value to charging roller 4 and detected by current detector 43 (FIG. 3). When CPU 511 determines that criterion current value Iac has exceeded 900 μA, the process returns to step S110, and when the CPU determines that criterion current value Iac is equal to or smaller than 900 μA, the process proceeds to step S130.

In step S130, CPU 511 instructs charging voltage supply portion 44 to lower the charging frequency. The frequency of an AC component of electric power supplied from charging voltage supply portion 44 to charging rollers 4Y, 4M, 4C, and 4K is thus lowered from frequency FA to frequency FB. Thereafter, the process proceeds to step S140.

In step S140, CPU 511 instructs development voltage supply portion 54 to lower a development frequency. The frequency of an AC component of electric power supplied from development voltage supply portion 54 to development rollers 6Y, 6M, 6C, and 6K is thus lowered. Thereafter, the process proceeds to step S150.

The development frequency may correspond to the charging frequency. For example, when the charging frequency is set to frequency FA, the development frequency is set to a frequency FX, and when the charging frequency is set to frequency FB, the development frequency is set to a frequency FY. Frequency FX has a value which is an integral multiple of frequency FA. Frequency FY has a value which is an integral multiple of frequency FB. As the development frequency is changed with change in charging frequency in image forming apparatus 200, such relation that the development frequency is an integral multiple of the charging frequency is maintained. To whichever of frequency FA and frequency FB the charging frequency may be set, production of interference fringes in electric power supplied to each of charging rollers 4Y, 4M, 4C, and 4K and electric power supplied to each of development rollers 6Y, 6M, 6C, and 6K is more reliably avoided and hence generation of noise in a developed image can more reliably be avoided. There may also be a case that only the charging frequency is changed with change in criterion current value Iac and the development frequency is not changed (step S140 and step S190 which will be described later are not performed).

In step S150, CPU 511 changes a set value for a system speed. The system speed refers, for example, to a speed of transportation of paper P in image forming apparatus 200. In step S150, for example, the system speed is lowered. The speed of transportation of paper P is thus lowered. Thereafter, the process proceeds to step S160.

CPU 511 determines in step S160 whether or not timing of new stabilization control has come. The process remains in step S160 until CPU 511 determines that the timing has come, and when the CPU determines that the timing has come, the process proceeds to step S170.

CPU 511 determines in step S170 whether or not criterion current value Iac at that time point is equal to or greater than a value (for example, "1100 μA") equal to or greater than a value defined as a threshold value in step S120. When CPU 511 determines that criterion current value Iac is smaller than 1100 μA, the process returns to step S160, and when the CPU determines that criterion current value Iac is equal to or greater than 1100 μA, the process proceeds to step S180.

In step S180, CPU 511 has charging voltage supply portion 44 (FIG. 3) change the frequency of electric power (charging frequency) supplied to charging rollers 4Y, 4M, 4C, and 4K from frequency FB to frequency FA. Thereafter, the process proceeds to step S190.

In step S190, CPU 511 has development voltage supply portion 54 (FIG. 3) return the frequency of electric power (development frequency) supplied to development rollers 6Y, 6M, 6C, and 6K from the frequency after change in step S140 to the frequency before change in step S140. Thereafter, the process proceeds to step S200.

In step S200, CPU 511 returns the set value for the system speed to the state before change in step S150. For example, the speed of transportation of paper P is increased and returns to the state before lowering in step S150. Thereafter, the process returns to step S110.

According to the process in FIG. 4 described above, whether or not the criterion current value is equal to or smaller than a first threshold value is determined at the timing of stabilization control (step S120), and when the criterion current value is equal to or smaller than the first threshold value, the charging frequency is lowered.

After the charging frequency is lowered, whether or not the criterion current value is equal to or greater than a second threshold value is determined (step S170), and when the criterion current value is equal to or greater than the second threshold value, the charging frequency is returned to the original frequency.

In the example in FIG. 4, the first threshold value is set to 900 μA and the second threshold value is set to 1100 μA. The second threshold value should only be equal to or greater than the first threshold value. Namely, the second threshold value may be equal to the first threshold value.

In image forming apparatus 200, setting of the charging frequency in steps S130 and S180, setting of the development frequency in steps S140 and S190, and setting of the system speed in steps S150 and S200 may be made as a part of stabilization control.

A voltage value used for detecting criterion current value Iac in the process described with reference to FIG. 4 does not necessarily have to be included in the voltage values used for determining a charging voltage in stabilization control.

Setting of the charging frequency based on the criterion current value as described above may be made at timing other than stabilization control. Such an example will be described below.

[Control (2) Based on Criterion Current Value]

Figure 5:
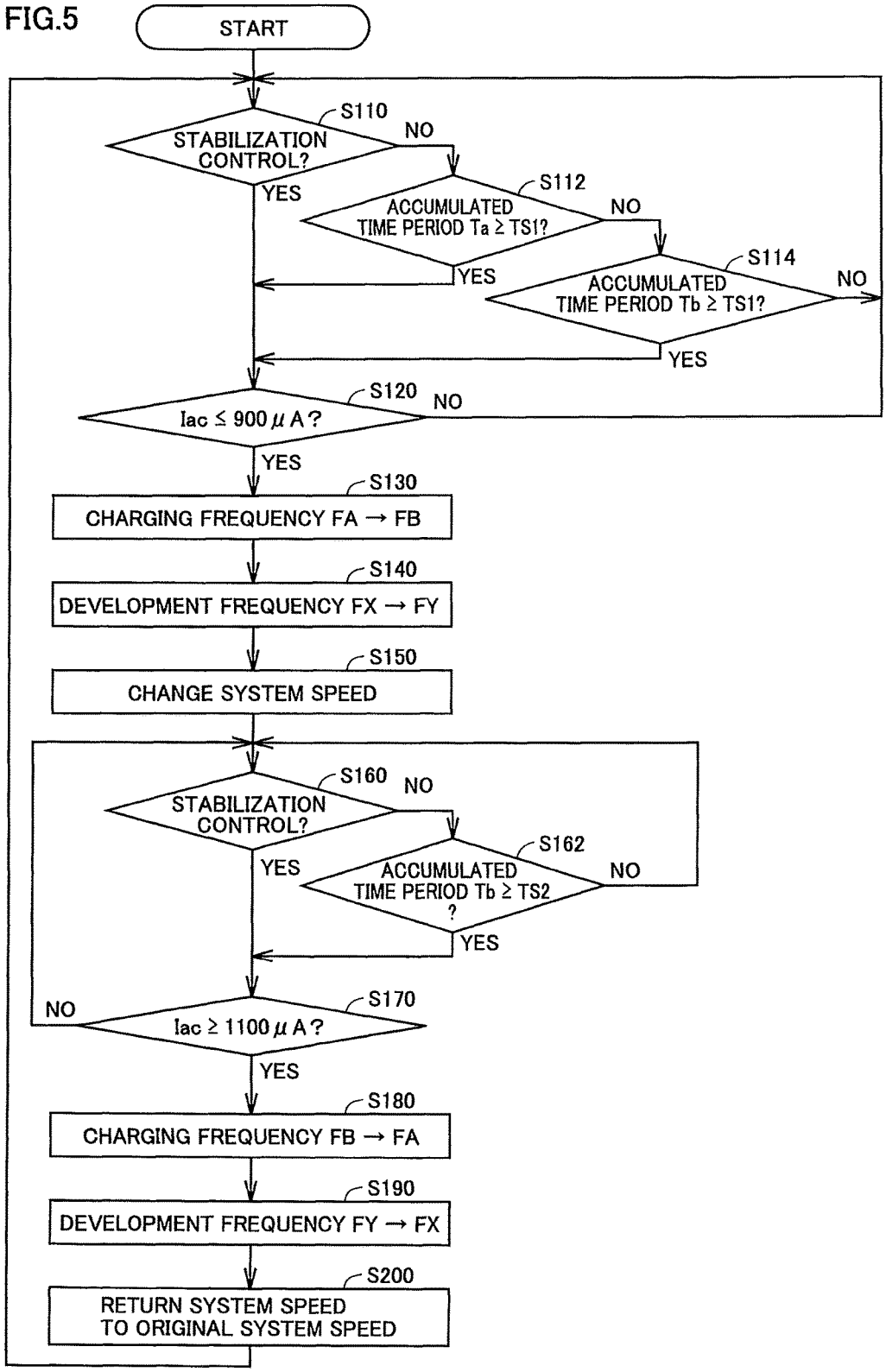
FIG. 5 is a diagram for illustrating a modification of the process in FIG. 4.

FIG. 5 is a diagram for illustrating a modification of the process in FIG. 4. As compared with the process in FIG. 4, steps S112, S114, and S162 are added in a process in FIG. 5. As a premise of the process in FIG. 5, CPU 511 is configured to store information for specifying an accumulated value of durations of application of a voltage to charging rollers 4C, 4K, 4M, and 4Y in memory 512.

In the process in FIG. 5, after CPU 511 determines in step S110 that timing of stabilization control has not yet come (NO in step S110), the process proceeds to step S112.

CPU 511 determines in step S112 whether or not an accumulated value (an accumulated time period Ta) of durations of application of a voltage to charging rollers 4C, 4K, 4M, and 4Y has reached a predetermined threshold value TS1. When CPU 511 determines that accumulated time period Ta has not reached threshold value TS1, the process proceeds to step S114, and when the CPU determines that accumulated time period Ta has reached threshold value TS1, the process proceeds to step S120.

CPU 511 determines in step S114 whether or not an accumulated value (an accumulated time period Tb) of durations of application of a voltage to charging rollers 4C, 4K, 4M, and 4Y after previous stabilization control has reached a predetermined threshold value TS2. When CPU 511 determines that accumulated time period Tb has not reached threshold value TS2, the process returns to step S110, and when the CPU determines that accumulated time period Tb has reached threshold value TS2, the process proceeds to step S120.

In step S120 to step S160, the process as described with reference to FIG. 4 is performed.

When CPU 511 determines in step S160 that the timing of new stabilization control has not yet come, the process proceeds to step S162.

CPU 511 determines in step S162 whether or not an accumulated value (accumulated time period Tb) of durations of application of a voltage to charging rollers 4C, 4K, 4M, and 4Y after previous stabilization control has reached predetermined threshold value TS2. When CPU 511 determines that accumulated time period Tb has not reached threshold value TS2, the process returns to step S160, and when the CPU determines that accumulated time period Tb has reached threshold value TS2, the process proceeds to step S170.

In step S170 to step S200, the process as described with reference to FIG. 4 is performed.

In the process in FIG. 5, the charging frequency may be changed based on the criterion current value when a time period (accumulated time period Ta) since start of application of a voltage to charging rollers 4C, 4K, 4M, and 4Y reaches threshold value TS1 or when a time period (accumulated time period Tb) since start of application of a voltage to charging rollers 4C, 4K, 4M, and 4Y since execution of stabilization control reaches threshold value TS2, in addition to the timing of stabilization control.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a photoconductor;

a charging member provided in proximity to the photoconductor;

a first power supply circuit configured to supply alternating-current power to the charging member;

a detector configured to detect a current value of an alternating current which flows to the charging member; and a controller configured to control an operation of the first power supply circuit, the controller being configured to lower a frequency of alternating-current power supplied to the charging member by the first power supply circuit when the current value detected by the detector in application of a voltage of a prescribed value to the charging member by the first power supply circuit is equal to or smaller than a predetermined value.

2. The image forming apparatus according to claim 1, wherein the controller is configured to increase the frequency of alternating-current power supplied to the charging member by the first power supply circuit when the current value detected by the detector in application of the voltage of the prescribed value to the charging member by the first power supply circuit is equal to or greater than a prescribed value equal to or greater than the predetermined value after the frequency of alternating-current power supplied by the first power supply circuit is lowered.

3. The image forming apparatus according to claim 1, the image forming apparatus further comprising:

a development member provided in proximity to the photoconductor; and a second power supply circuit configured to supply alternating-current power to the development member, wherein the controller is configured to change a frequency of alternating-current power supplied to the development member by the second power supply circuit in response to lowering in frequency of alternating-current power supplied to the charging member by the first power supply circuit.

4. The image forming apparatus according to claim 3, wherein the controller is configured to return the frequency of alternating-current power supplied to the development member by the second power supply circuit to a frequency before change when an internal temperature of the image forming apparatus is equal to or higher than a prescribed temperature equal to or higher than a predetermined temperature.

5. The image forming apparatus according to claim 1, wherein the controller is configured to lower the frequency of alternating-current power supplied to the charging member by the first power supply circuit when an accumulated time period of application of the voltage to the charging member is equal to or longer than a predetermined time period and when a value of a current which flows to the charging member in application of the voltage of the prescribed value to the charging member by the first power supply circuit is equal to or smaller than the predetermined value.

6. The image forming apparatus according to claim 1, wherein the controller is configured to determine a voltage value of alternating-current power supplied to the charging member by the first power supply circuit based on an internal temperature of the image forming apparatus and to lower the frequency of alternating-current power supplied to the charging member by the first power supply circuit when an accumulated time period of application of the voltage to the charging member is equal to or longer than a prescribed time period after determination of the voltage value based on the internal temperature of the image forming apparatus and when a value of a current which flows to the charging member in application of the voltage of the prescribed value to the charging member by the first power supply circuit is equal to or smaller than the predetermined value.

7. A method of controlling an image forming apparatus including a photoconductor and a charging member provided in proximity to the photoconductor and supplied with electric power containing an alternating-current component, the method comprising:

obtaining a value of a current which flows to the charging member when a voltage of a prescribed value is applied to the charging member; and lowering a frequency of alternating-current power supplied to the charging member when the obtained value of the current is equal to or smaller than a predetermined value.

8. The method according to claim 7, further comprising increasing the frequency of alternating-current power supplied to the charging member when the value of the current which flows to the charging member in application of the voltage of the prescribed value to the charging member is equal to or greater than a prescribed value equal to or greater than the predetermined value after the frequency of alternating-current power supplied to the charging member is lowered.

9. The method according to claim 7, wherein the image forming apparatus further includes a development member provided in proximity to the photoconductor, and the method further comprises changing a frequency of alternating-current power supplied to the development member in response to lowering in frequency of alternating-current power supplied to the charging member.

10. The method according to claim 9, further comprising returning the frequency of alternating-current power supplied to the development member to a frequency before change when an internal temperature of the image forming apparatus is equal to or higher than a prescribed temperature equal to or higher than a predetermined temperature.

11. The method according to claim 7, further comprising lowering the frequency of alternating-current power supplied to the charging member when an accumulated time period of application of the voltage to the charging member is equal to or longer than a predetermined time period and when the value of the current which flows to the charging member in application of a prescribed voltage to the charging member is equal to or smaller than the predetermined value.

12. The method according to claim 7, further comprising:

determining a voltage value of alternating-current power supplied to the charging member based on an internal temperature of the image forming apparatus; and lowering the frequency of alternating-current power supplied to the charging member when an accumulated time period of application of the voltage to the charging member is equal to or longer than a prescribed time period after determination of the voltage value based on the internal temperature of the image forming apparatus and when the value of the current in application of a prescribed voltage to the charging member is equal to or smaller than the predetermined value.

* * * * *